United States Patent [19]

Hynes et al.

[11] Patent Number: 4,616,979

[45] Date of Patent: Oct. 14, 1986

[54] MOBILE PUMP SYSTEM

[75] Inventors: Maurice A. Hynes, Fort Lauderdale; Roger L. Freeman, Lauderhill, both of Fla.

[73] Assignee: Atlantic Hydrodynamics, Inc., Fort Lauderdale, Fla.

[21] Appl. No.: 509,020

[22] Filed: Jun. 29, 1983

[51] Int. Cl.[4] ..... F04B 17/06; F04B 35/06

[52] U.S. Cl. ..... 417/231; 417/234; 417/361

[58] Field of Search ..... 417/231, 233, 361, 360, 417/234; 92/118, 61, 2; 138/106, 155, 120

[56] References Cited

U.S. PATENT DOCUMENTS

| | | | |
|---|---|---|---|
| 1,019,610 | 3/1912 | Donnelly . | |
| 1,206,790 | 12/1916 | Andrews . | |
| 2,664,052 | 12/1953 | Schmidt . | |
| 3,008,422 | 11/1961 | Crisafulli . | |
| 3,253,357 | 5/1966 | Allard | 417/234 |
| 3,657,969 | 4/1972 | Wirkus | 92/118 |
| 3,779,670 | 12/1973 | Crisafulli | 417/231 |
| 3,905,725 | 9/1975 | Johnson | 417/231 |
| 3,910,722 | 10/1975 | Hochmuth | 417/34 |
| 4,070,135 | 1/1978 | Eller | 417/234 |
| 4,082,191 | 4/1978 | Whittingham | 92/118 |
| 4,375,943 | 3/1983 | Stuart | 417/231 |

FOREIGN PATENT DOCUMENTS

| | | | |
|---|---|---|---|
| 1012841 | 6/1977 | Canada | 417/231 |
| 2206612 | 8/1973 | Fed. Rep. of Germany | 417/231 |

OTHER PUBLICATIONS

M&W Pump Corporation advertising brochure entitled "M&W Pump Corp. Introduces the Hydroflo Large Axial Flow Pumps Hydraulically Driven," copyrighted 1980.

*Primary Examiner*—Cornelius J. Husar
*Assistant Examiner*—Peter M. Cuomo
*Attorney, Agent, or Firm*—Banner, Birch, McKie & Beckett

[57] ABSTRACT

This invention relates to a self-contained mobile pump system for pumping water from irrigation ditches and the like. The pump system is hydraulically controlled for extending, retracting, and angling the pump system to accommodate various pumping positions and water levels.

14 Claims, 4 Drawing Figures

HYDRAULIC SYSTEM

MOBILE PUMP SYSTEM

BACKGROUND OF THE INVENTION

This invention relates to a self-contained, mobile pump system which can be conveniently placed adjacent a body of water such as an irrigation ditch, a canal, excavation or other body of water from which it is desired to remove water and discharge it to another position.

Mobile pump systems are well known and commonly used for pumping water from one place to another. These systems usually include an internal combustion engine mounted on a suitable carriage. These systems generally include an elongated conduit or discharge tube with a pump or motor mounted within the tube. In order to be capable of operation at various water levels, prior art mobile pump systems have used complex winch and pulley systems to adjust the angle at which the discharge tube is placed in the water. Examples of typical prior art mobile pump systems which use these complex pulley and winch systems include U.S. Pat. No. 3,008,422 and U.S. Pat. No. 4,070,135. These prior are devices, however, require complex rigging and have not provided the precise degree of control and easy operability that is desired in a mobile pump apparatus.

For example, U.S. Pat. No. 4,070,135 employs a cradle carried by a pivotally articulated slide. The articulated slide in U.S. Pat. No. 4,070,135 is pivotable to allow the discharge tube to be submersed into the water at any desired angle. The cradle carries the discharge tube. The slide is slidable from one end of the mobile pump system to the other on guide bars which are inclined upward at a very small angle from back to front of the pump system. Thus, this system requires gravity to allow the discharge tube to descend along the guide bars and appropriately position the intake end of the discharge tube. If the mobile pump is placed, for example, on an inclined levy, however, gravity forces cannot assist the movement of the slide and the effectiveness and efficiency of this device are severely diminished.

The prior art mobile pump system requires both a pulley and a winch with appropriate supporting cable connections to be attached to the discharge pipe to control the gravity fall of the discharge pipe and slide along the inclined guide bars. The supporting cable from the winch and pulley may need to be disengaged and repositioned along the discharge pipe to support the weight of the submersible unit beyond the cart on which the unit sits if the weight exceeds the buoyant effect of the water. Moreover, the winch and pulley restraining system and cable positioning requirements of this device make the system difficult and cumbersome for one person to operate.

SUMMARY OF THE INVENTION

The present invention overcomes the disadvantages of the prior art by providing a self-contained mobile pump system which is hydraulically-actuated to provide easy, precise and positive operator control of the positioning and angulation of the discharge pipe to accommodate pumping from various water levels. The present invention, unlike prior art devices, does not require complex rigging to control the discharge tube. Additionally, the present invention does not rely on gravity forces to place the pump in its operating position.

The mobile pump system of the present invention contains a self-contained power source, which preferably inclues a diesel engine and a fuel reservoir for providing fuel to the diesel engine. The diesel engine drives a hydraulic fluid supply source which supplies fluid to all of the hydraulically actuated mechanisms in the pump system. The pump system of the present invention includes a hydraulic motor and an axial flow hydraulic pump driven by the hydraulic motor. The pump system includes an elongated discharge tube which has an intake and a discharge end. The intake end is positioned within a body of water and water is pumped through the tube out the discharge end to any desired location. A discharge hose may be removably connected to the discharge end of the discharge tube to facilitate moving water from one position to another. Both the hydraulic pump and the hydraulic motor are preferably located within the discharge tube and preferably near the intake end of the discharge tube. Both the hydraulic pump and hydraulic motor or capable of being submersed within water.

The discharge tube of the mobile pump system is fixed to a hydraulically actuated, linearly extensible boom cylinder. Preferably, the boom cylinder is connected to the discharge end of the discharge tube so that as the boom cylinder is extended and retracted the discharge tube is also extended and retracted. A plurality of roller guides may support the discharge tube on the boom cylinder and facilitate its extension and retraction. A pivot bracket is fixed to the boom cylinder and provides a pivot point below the boom cylinder about which the discharge tube and the boom cylinder are pivotable. A hydraulically actuated pivot arm fixed to the boom cylinder causes the discharge tube and the boom cylinder to pivot about the pivot point. Control means are included for independently controlling the hydraulic systems of the invention.

In a preferred embodiment, the boom cylinder includes a plurality of linearly extensible telescoping members and a hydraulic cylinder within the boom cylinder for independently extending and retracting the telescoping members.

Preferably, the pivot arm is pivotally connected to the boom cylinder by a sleeve encircling the boom cylinder and a pivot bracket fixed to the sleeve. A pivot pin passes through the end of the pivot arm through the pivot bracket and serves as the pivot point about which the boom cylinder and discharge tube are pivotable.

Preferably, the pump system is contained on a wheeled transportable trailer to facilitate the system being moved from one position to another.

DESCRIPTION OF THE PREFERRED EMBODIMENT

Figure 1:
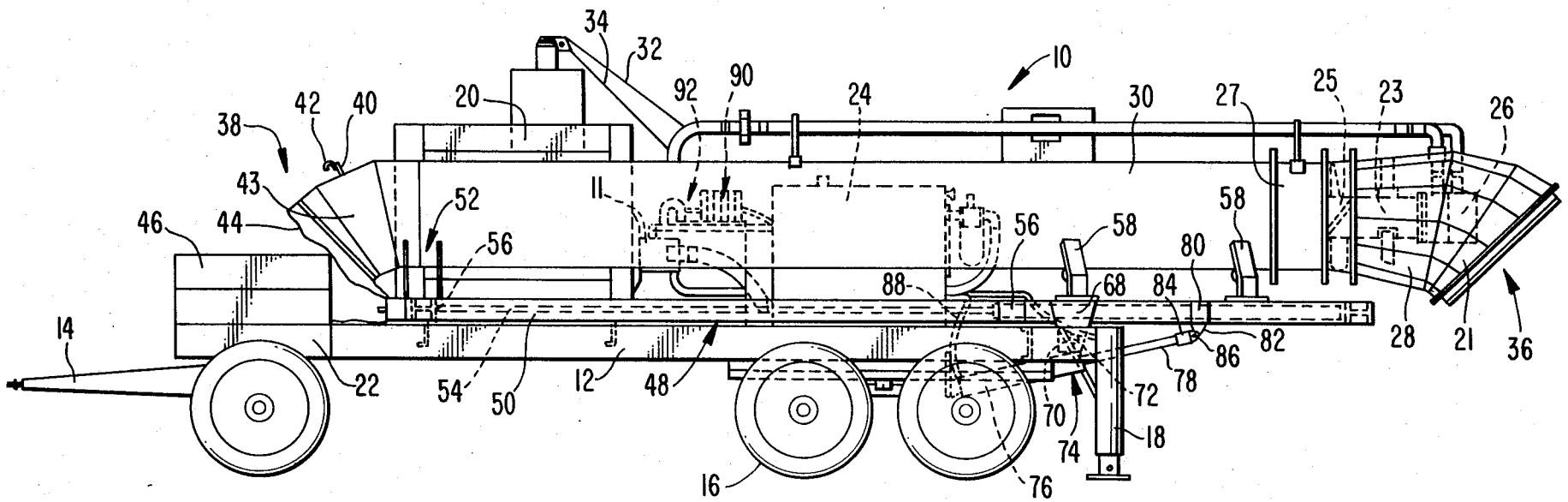
FIG. 1 is a side plan of a mobile pump system according to the present invention.
Figure 2:
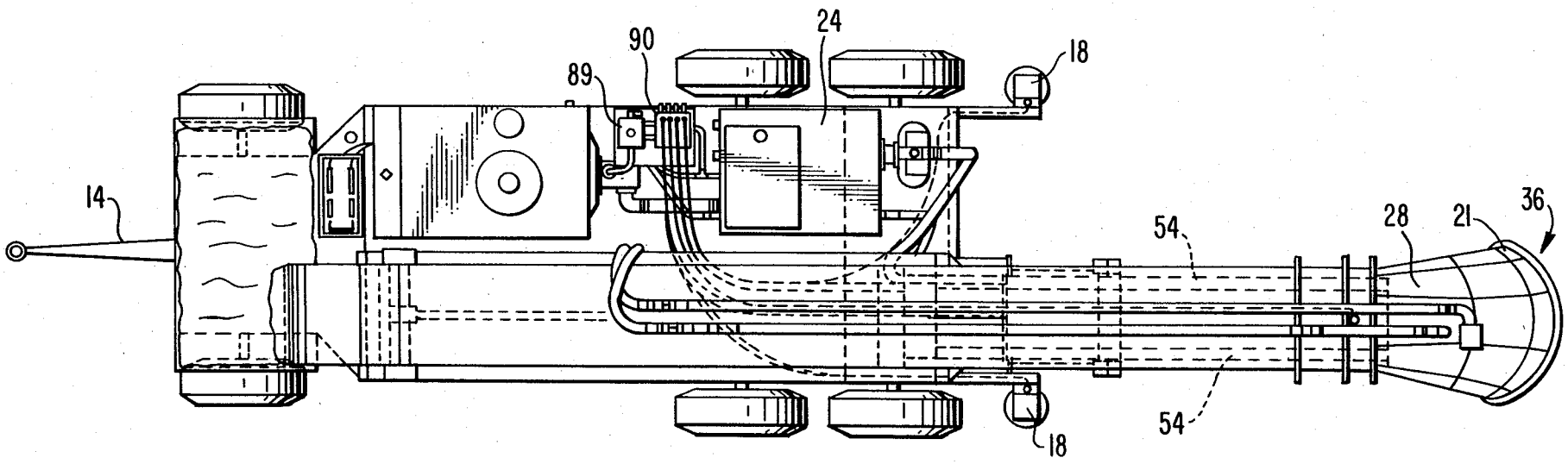
FIG. 2 is a top plan view of the mobile pump system shown in FIG. 1.

The mobile pump system of the present invention is shown generally at 10. The entire system is self-contained on a movable trailer 12. Trailer 12 preferably has a front automotive steering axle and tow bar, shown generally at 14, to facilitate its being towed by a truck, tractor or other vehicle. Trailer 12 includes flotation tires 16 which allow the trailer to be partially submersed in water. An adjustable hydraulically actuated stand 18 is fixed to trailer 12 and supports and stabilizes trailer 12 when it is placed in pumping position. Stand 18 is rotatable to a position under trailer 12 when the pump system is being transported.

Pump system 10 includes a self-contained power source. Preferably, this power source is a diesel engine 20 and a fuel reservoir 22 for supplying fuel to engine 20. A reservoir of hydraulic fluid 24, a hydraulic pump 11, hydraulic fluid supply conduits and a control mechanism serve to provide hydraulic fluid to all the hydraulically activated mechanisms throughout pump system 10, as will be described. An automatic shut down system may be included for both the diesel engine system and for the hydraulic supply system.

A hydraulic motor 26 and, preferably, an axial flow pump 28 driven by motor 26 are positioned within an elongated discharge tube 30 of pump system 10, preferably near the intake end 36 of discharge tube 30. However, pump 28 may be any hydraulically driven, submersible pump, such as a centrifugal pump or a mixed flow pump.

An intake bell 21 may be fixed to intake end 36 of discharge tube 30. Intake bell 21 may be angled at an angle convenient for the operating conditions. It has been found that a 45 angle for intake bell 21 is helpful in most pumping conditions to facilitate water intake through intake end 36. A bearing carrier 23 is positioned within intake end 36 to facilitate rotation of hydraulic motor 26. A propeller blade 25 driven by pump 28 is positioned within discharge tube 30. Both motor 26 and bearing carrier 23 can alternatively be positioned above propeller 25. Discharge tube 30 may also include a difuser section 27. Preferably, propeller blade 25 is of stainless steel and may be provided with a stainless steel liner.

Elongated discharge tube 30 forms the conduit through which water will flow as it is pumped by axial flow pump 28 from the intake end 36 of discharge tube 30, through the discharge tube, and out the discharge end 38 of discharge tube 30. A check valve 40 for controlling an air relief pipe 42 may be included on the discharge end of discharge tube 30. Preferably, a discharge elbow 43 is fixed to discharge end 38 which facilitates connecting a discharge hose, shown generally at 44, to discharge end 38. Discharge elbow 43 also permits discharge hose 44 to be connected to discharge tube 30 without interfering with any of the operable parts of mobile pump system 10 or the vehicle used to tow the system. Discharge hose 44 is a conventional hose which may be unfolded to allow water to be directed to a position remote from discharge end 38. Preferably, discharge hose 44 is contained in a discharge hose container shown generally at 46.

Discharge tube 30 is fixed to a multi-angular extension apparatus shown generally at 48, which serves to extend, retract and angle discharge tube 30. Apparatus 48 is fixed to and carried by trailer 12. Apparatus 48 includes a hydraulically actuated, linearly extensible boom cylinder 50. Boom cylinder 50 extends substantially the entire axial length of discharge tube 30, as shown in FIG. 1. Boom cylinder 50 is securely fastened to discharge tube 30 near the discharge end 38 of discharge tube 30, as shown generally at 52. This connection may be any commonly used and convenient connection such as welding, bolts or other connecting means. Boom cylinder 50 includes a plurality of linearly extensible telescoping members 54, and hydraulic cylinder 56 for extending and retracting telescoping members 54.

A plurality of roller guides 58 are provided to facilitate the extension and retraction of discharge tube 30. Roller guides 58 include any commonly known roller elements or other bearing surfaces whih will facilitate movement of discharge tube 30.

A pivot bracket 68 is fixed to boom cylinder 50 as shown in FIG. 1. Pivot bracket 68 is preferably fastened to the outermost member of telescoping members 54. Pivot bracket 68 includes a pivot rod 70 which defines a pivot point 72 about which boom cylinder 50 and discharge tube 30 are pivotable. As shown in FIG. 1, pivot point 72 is preferably placed below boom cylinder 50.

Figure 3:
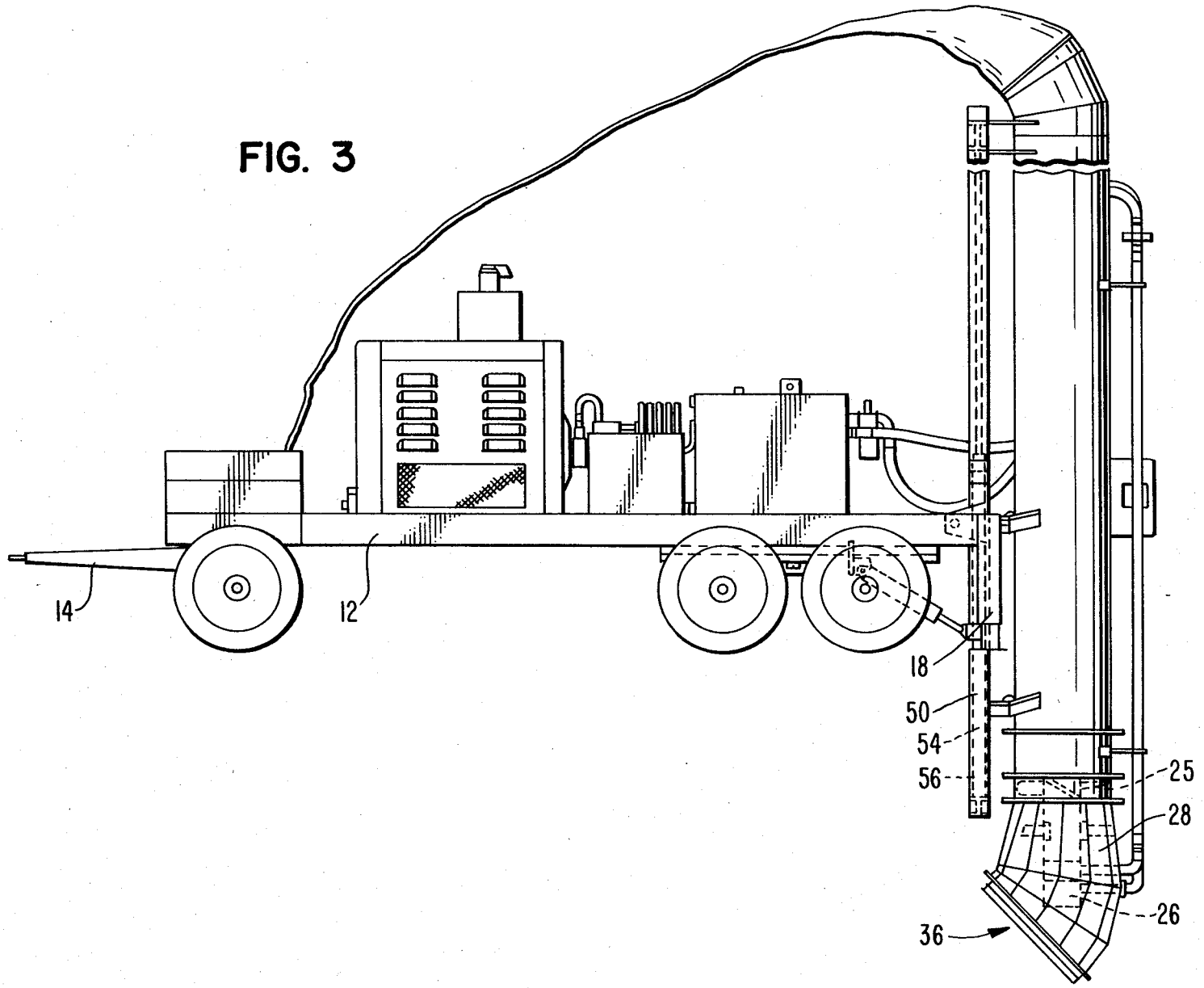
FIG. 3 is a schematic side view of a mobile pump system according to the present invention shown in its extended, most angled, operating position.
Figure 4:
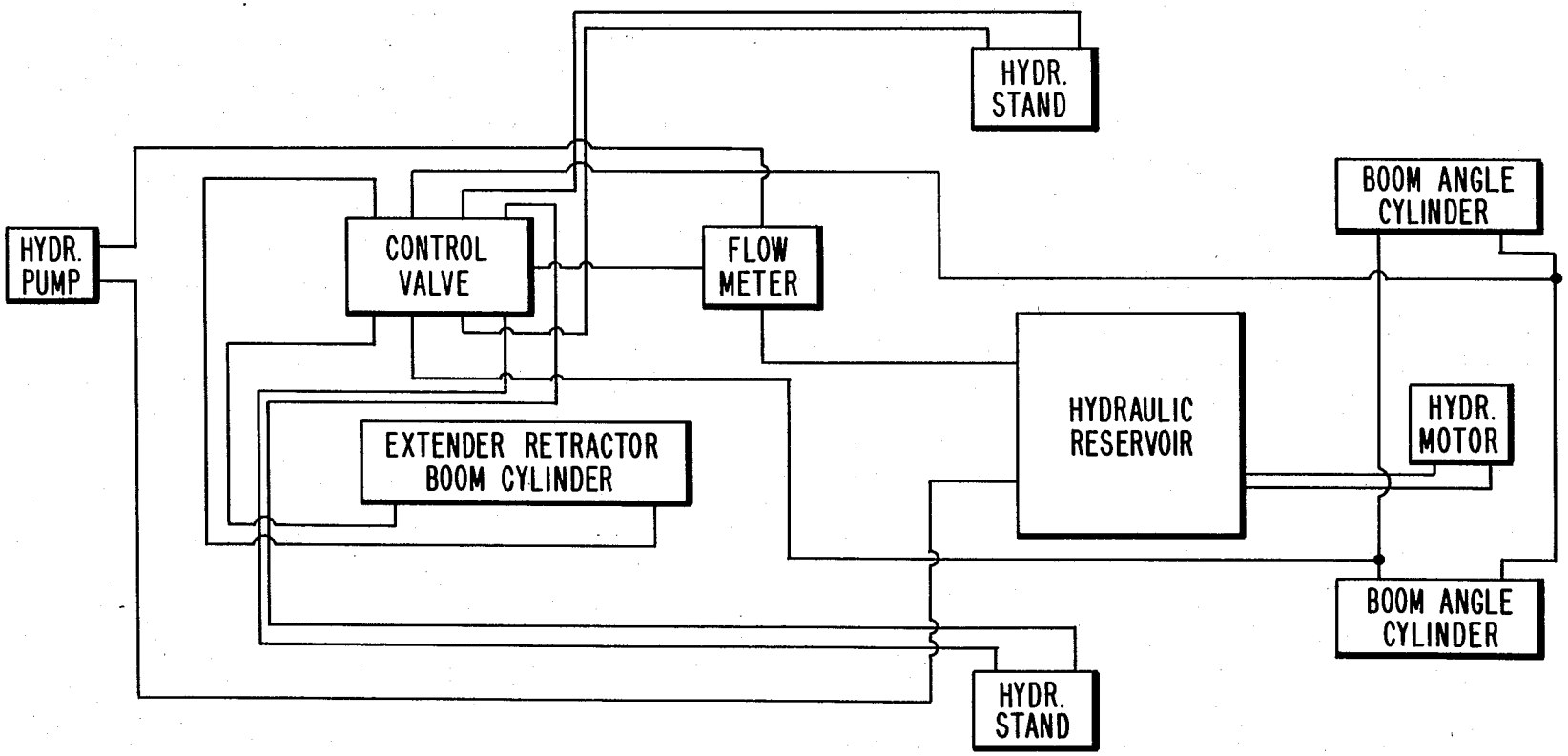
FIG. 4 is a schematic diagram of the hydraulic control system of the present invention.

Hydraulically actuated pivot actuating means, shown generally at 74, are attached to boom cylinder 50 and serve to pivot boom cylinder 50 and the attached discharge tube 30 about pivot point 72. Pivot actuating means 74 include hydraulic cylinders 76 and an extensible pivot arm 78 actuated by hydraulic cylinders 76. Pivot arm 78 is pivotably connected to boom cylinder 50 so that as pivot arm 78 is extended and retracted, boom cylinder 50 and discharge tube 30 are rotated about pivot point 72, as shown in FIG. 3. FIG. 3 illustrates the invention in its most angled position, i.e., essentially perpendicular to the body of fluid being pumped. It will be understood that the angle of boom cylinder 50 and discharge tube 30 can be adjusted by hydraulic cylinders 76 to be any angle between the horizontal position shown in FIG. 1 and the essentially vertical position shown in FIG. 3.

The pivotable connection between pivot arm 78 and boom cylinder 50 includes a sleeve 80 which surrounds boom cylinder 50, preferably surrounding the outermost member of telescoping members 54 and a pivot bracket 82 which is fixed to sleeve 80 below boom cylinder 50. Pivot arm 78 is retained within a collar 84 which is hingedly connected to pivot bracket 82 by a pin 86 so that as pivot arm 78 is extended and retracted it may pivot about pin 86.

Hydraulic cylinders 76 are preferably fixed to trailer 12. Hydraulic fluid pumped by hydraulic pump 11 from reservoir 24 is carried to hydraulic cylinders 76 by hydraulic supply lines shown generally at 88.

As shown in FIG. 1, pivot arm 78 is preferably fixed to boom cylinder 50 at a point closer to intake end 36 then is pivot bracket 68. Thus, as pivot arm 78 is retracted by hydraulic cylinders 76, boom cylinder 50 and discharge 30 are rotated in a clockwise direction about pivot point 72, thus forcing intake end of discharge tube 30 to descend and angle downwardly into its operating position. As pivot arm 78 is extended by hydraulic cylinders 76, boom cylinder 50 and discharge tube 30 are rotated about pivot point 72 in a counterclockwise direction thus driving intake end 36 towards its horizontal, out of the water position.

An automatic shut down system for both the hydraulic system and for the engine system, shown generally at 92, is may also be included in pump system 10.

Hydraulic pump 11 pumps hydraulic fluid from reservoir 24 through flow divider 89. Flow divider 89 directs hydraulic fluid either to control mechanism 90, motor 26, or returns fluid to reservoir 24. Control mechanism 90 is selectively actuated to divert hydraulic fluid through appropriate conduits to the desired hydraulic auxilliary system, i.e., the stand 18 cylinder 56, or cylinders 76, as described below, on pump system 10. When the desired auxilliary hydraulic system has been fully actuated, flow divider 89 is positioned to lock in hydraulic pressure in the fully actuated system and to divert hydraulic fluid from control mechanism 90 to hydraulic motor 26.

Although a particular embodiment has been described, the invention is not intended to be limited thereby. Various modifications will occur to those of ordinary skill in the art and the invention is defined only by the following claims.

We claim:

1. A mobile pump system comprising:

a self-contained power source;

hydraulic fluid supply means powered by said power source for supplying pressurized hydraulic fluid to the pump system;

a hydraulic motor;

a hydraulically-driven submersible pump driven by said hydraulic motor;

a rigid discharge tube having an intake end and a discharge end, said hydraulic pump and said hydraulic motor located within said discharge tube near the intake end of said discharge tube;

a hydraulically-actuated, linearly extensible, multi-angular extension means fixed to said discharge tube for linearly extending and retracting said discharge tube at various angles with respect to a horizontal plane;

a single pivot assembly fixed to said hydraulically-actuated linearly extensible extension means for pivoting said discharge tube and said extension means, said single pivot assembly comprising a pivot bracket fixed to said extension means, said pivot bracket having a pivot point located below the horizontal plane of said extension means;

hydraulically driven pivot actuating means fixed to said hydraulically-actuated, linearly extensible, multi-angular extension means for pivoting said discharge tube and said extension means about said pivot point, said pivot actuating means comprising a hydraulically extensible pivot arm, flexibly coupled to said extension means so that as said pivot arm is actuated said extension means and said rigid discharge tube are pivoted about said pivot point;

control means for independently controlling and maintaining the supply of hydraulic fluid in the pump system; and transport means for transporting the pump system from one position to another position.

2. A mobile pump system as recited in claim 1 wherein said extension means comprises a plurality of linearly extensible telescoping members and a hydraulic cylinder within said extensible members for extending and retracting said telescoping members.

3. A mobile pump system as recited in claim 2 wherein said pivot actuating means further comprise a sleeve encircling said extension means and said pivot bracket fixed to said sleeve, and wherein said pivot arm is pivotably connected to said pivot bracket.

4. A mobile pump system as recited in claim 2 wherein said pivot actuating hydraulic cylinder is fixed to said transport means.

5. A mobile pump system as recited in claim 1 wherein said transport means comprise a wheeled trailer and said trailer includes tow means for towing said trailer by a vehicle.

6. A mobile pump system as recited in claim 1 further comprising a hydraulically actuated stand for supporting the pump system, and wherein said control means control and maintain the supply of hydraulic fluid to said stand.

7. A mobile pump system as recited in claim 1 wherein said control means comprises a flow divider and control valves, said control valves control the flow of hydraulic fluid through said hydraulic fluid supply means to said extension means and said pivot actuating means, and wherein said flow divider diverts hydraulic fluid to said hydraulic motor or said control valves.

8. A mobile pump system as recited in claim 1 further comprising a discharge hose removably connected to said discharge end of said discharge tube.

9. A mobile pump system as recited in claim 1 wherein said pump is an axial flow pump.

10. A mobile pump system comprising:

a self-contained power source;

hydraulic fluid supply means powered by said power source for supplying pressurized hydraulic fluid to the pump system;

a hydraulic motor;

a hydraulically-driven submersible pump driven by said hydraulic motor;

a rigid discharge tube having an intake end and a discharge end, said hydraulic pump and said hydraulic motor located within said discharge tube near the intake end of said discharge tube;

a hydraulically-actuated, linearly extensible, multi-angular boom cylinder fixed to said discharge tube near the discharge end of said discharge tube for linearly extending and retracting said discharge tube at various angles with respect to a horizontal plane, said boom cylinder having a plurality of roller guides supporting said discharge tube;

a single pivot bracket fixed to said boom cylinder and comprising a pivot point below said boom cylinder about which both said discharge tube and said boom cylinder are pivotable;

at least one pivot hydraulic cylinder and a single extensible pivot arm actuated by said pivot hydraulic cylinder, said pivot arm pivotally connected to said boom cylinder so that as said pivot arm is extended and retracted said boom cylinder and discharge tube pivot about said pivot point;

control means for controlling and maintaining the supply of hydraulic fluid in said boom cylinder, said hydraulic cylinder, and said hydraulic motor; and a wheeled trailer for transporting the entire pump system from one position to another.

11. A mobile pump system as recited in claim 10 wherein said boom cylinder comprises a plurality of linearly extensible telescoping members and a boom cylinder hydraulic cylinder within said extensible members for extending and retracting said extensible members.

12. A pump system as recited in claim 11 further comprising a hydraulically actuated stand pivotally attached to said trailer for supporting said trailer in its operating position, and wherein said control means control and maintain the supply of hydraulic fluid in said stand.

13. A pump system as recited in claim 12 wherein said control means comprises control valves directing hydraulic fluid through said hydraulic fluid supply means to each of said stand, said boom cylinder, hydraulic cylinder, and said pivot hydraulic cylinder, and further comprises a flow divider for maintaining the hydraulic fluid in each of said stand, said boom cylinder, hydraulic cylinder and said pivot hydraulic cylinders and for diverting hydraulic fluid from said control valves to said hydraulic motor.

14. A mobile pump system as recited in claim 13 further comprising a discharge hose removably connected to said discharge end of said discharge tube.

* * * * *